US005669241A

United States Patent [19]

Kohl

[11] Patent Number: 5,669,241

[45] Date of Patent: Sep. 23, 1997

[54] HINGED FINGER RING

[76] Inventor: Tammy Kohl, 312 N. Carpenter, Chicago, Ill. 60607

[21] Appl. No.: 620,461

[22] Filed: Mar. 22, 1996

[51] Int. Cl.[6] ..... A44C 9/00

[52] U.S. Cl. ..... 63/15.2; 63/15.1

[58] Field of Search ..... 63/15, 15.1, 15.2, 63/15.3, 15.7, 15.8

[56] References Cited

U.S. PATENT DOCUMENTS

| | | | |
|---|---|---|---|
| D. 254,606 | 4/1980 | Abelson | D11/34 |
| D. 309,276 | 7/1990 | Mejias | D11/26 |
| 984,803 | 2/1911 | Dinuccio . | |
| 1,178,186 | 4/1916 | Spaney | 63/15.7 |
| 1,596,642 | 8/1926 | Weber | 63/15.4 |
| 1,724,130 | 8/1929 | Dayton et al. . | |
| 1,929,236 | 10/1933 | Bridler | 63/15 |
| 1,936,604 | 11/1933 | Moldenhauer | 63/16 |
| 2,048,878 | 7/1936 | Moldenhauer | 63/16 |
| 2,177,314 | 10/1939 | Von Dachenhausen | 63/15.4 |
| 2,182,876 | 12/1939 | Moldenhauer | 63/15 |
| 2,220,408 | 11/1940 | Kalina | 63/16 |
| 3,307,374 | 3/1967 | Kirshbaum | 63/15 |
| 3,307,375 | 3/1967 | Estrin et al. | 63/15 |
| 4,307,502 | 12/1981 | Scola | 29/160.6 |
| 4,311,026 | 1/1982 | Ochoa | 63/15 |
| 5,253,490 | 10/1993 | Doganay | 63/15.4 |
| 5,419,158 | 5/1995 | Sandberg et al. | 63/15.4 |

*Primary Examiner*—Kien T. Nguyen
*Attorney, Agent, or Firm*—Gardner, Carton & Douglas

[57] ABSTRACT

The present invention discloses a finger ring having at least two member, preferably toroidal, that are connected together at a point by a hinge. Diametrically opposite the hinge point, the first member has a clasp hingably connected thereto. Diametrically opposite the hinge point, the second member has a catch. In a closed position, the clasp engages with the catch to form a finger ring having unitary appearance. The first and second members can be configured with informative and decorative indicia on the inner mating surfaces of the members.

18 Claims, 1 Drawing Sheet

HINGED FINGER RING

BACKGROUND OF THE INVENTION

1. Field of the Invention

The present invention relates to a finger ring and, in particular, a finger ring that has two toroidal members that are latched together to form a ring having a unitary appearance.

2. Scope of the Prior Art

Finger rings have long been worn by both men and women as decorative jewelry. These finger rings come in many different styles. Some have engraving on the inner and outer surfaces of the ring, and other hold gemstones of various sizes and shapes.

Often finger rings are given as presents or gifts from one person to another. In a typical courtship, a man will give an engagement ring when asking a women to marry him. At the actual wedding, the man and woman exchange rings. Frequently, the man and the woman will exchange finger rings having an identical appearance. To commemorate the occasion, the finger rings may be engraved on the inner surface of the ring with the name of the betrothed and the date of the marriage. These wedding rings can also have gemstones on the outer surface. In addition to the man and woman's wedding rings being identical, the woman's engagement ring and wedding ring can have a similar style and fit together to form a set.

Of the many different styles of finger rings available, one such style is a multi-part ring. Some of these multi-part rings have at least two ring parts that are connected together using a hinge. These hinged rings can form one ring or can surround another ring as a guard. These hinged rings can use one or two hinges and the various parts can be rotated relative to one another in various directions In addition, some of these hinged rings include a catch that secures the two parts together.

One such hinged two-part finger ring is disclosed in U.S. Pat. No. 3,307,375 to Estrin et al. The ring disclosed are connected at one point by a hinge. At a point on the ring diametrically opposite the hinge, a latch holds the two parts together. The latch is connected to one ring part and has a flexible tongue extending at an angled end. The other ring part includes a slot which removably connects the angled end of the latch thereby holding the two ring parts together. When the two parts are rotated together about the hinge, the tongue flexes when it meets the opposing ring part so that the angled end will fit into the slot. The ring also includes an overlay which covers the hinge and the latch to give the ring an aesthetic appearance. In this embodiment of the prior art, the hinge is arranged on the finger ring near the palm of the hand so that it is not normally visible.

In view of the prior art, what is needed is a ring that has at least two parts that are hinged together and has a unitary appearance with the hinge an integral part of the ring. What is also required is a finger ring that can have both engraving and gemstones on various surfaces of the ring.

SUMMARY OF THE INVENTION

It is an object of the present invention to provide a finger ring that has at least two portions that are connected by a hinge at a point along the ring.

It is also an object of the present invention to provide a finger ring that has at least two connected portions and has a unitary appearance.

It is another object of the present invention to provide a finger ring that has a clasp to hold at least two portions of the finger ring together in a unitary appearance.

It is still another object of the invention to provide a finger ring that has a clasp and catch whereby the clasp engages with the catch to form a ring having a unitary appearance.

It is a further object of the invention to provide a finger ring that has at least two portions hingably connected together and that provides a mating surface for informational and decorative indicia.

It is yet a further object of the invention to provide a finger ring that has at least two portions where the inner mating surfaces of the portions are generally planar and provide surfaces of informational and decorative indicia.

The present invention comprises of a finger ring that has at least two toroidal members that are connected to one another in an axial adjacent relationship by a hinge. One end of the hinge is connected to the first of the at least two toroidal members, and the other end of the hinge is connected to the second of the at least two toroidal members. Diametrically opposite the hinge, a clasp is movably connected to the first member. At a point diametrically opposite the hinge point, a catch is provided on the second member. The end of the clasp opposite the hinged end can be removably connected to the catch. When the clasp is connected to the catch, the members form a finger ring having a unitary appearance. Once the clasp is removed from the catch, the two toroidal members can rotate about the ring hinge.

The mating surfaces of the two toroidal surfaces are preferably disc shaped and planar. These generally planars surface can have informative indicia etched onto the surfaces or that can have decorative indicia placed into the surfaces. The informative indicia can include a name or a date. The decorative indicia can include gemstones and enamel. The outer surface of the toroidal members can also have informative and decorative indicia. In addition, the surfaces of the clasp can have indicia.

These and numerous other features and advantages of the present invention will become readily apparent from the following description, the accompanying drawings and the appended claims.

DETAILED DESCRIPTION OF THE PREFERRED EMBODIMENT

Figure 1:
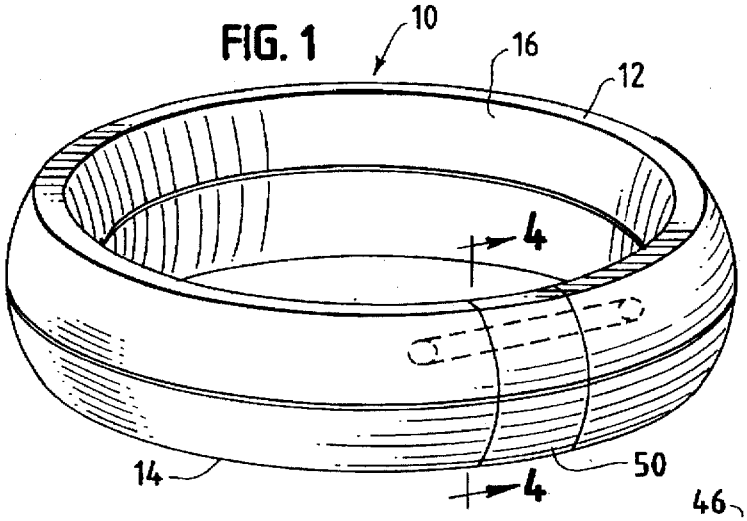
FIG. 1 is a perspective view of a finger ring in the closed position made in accordance with the principles of the present invention.
Figure 3:
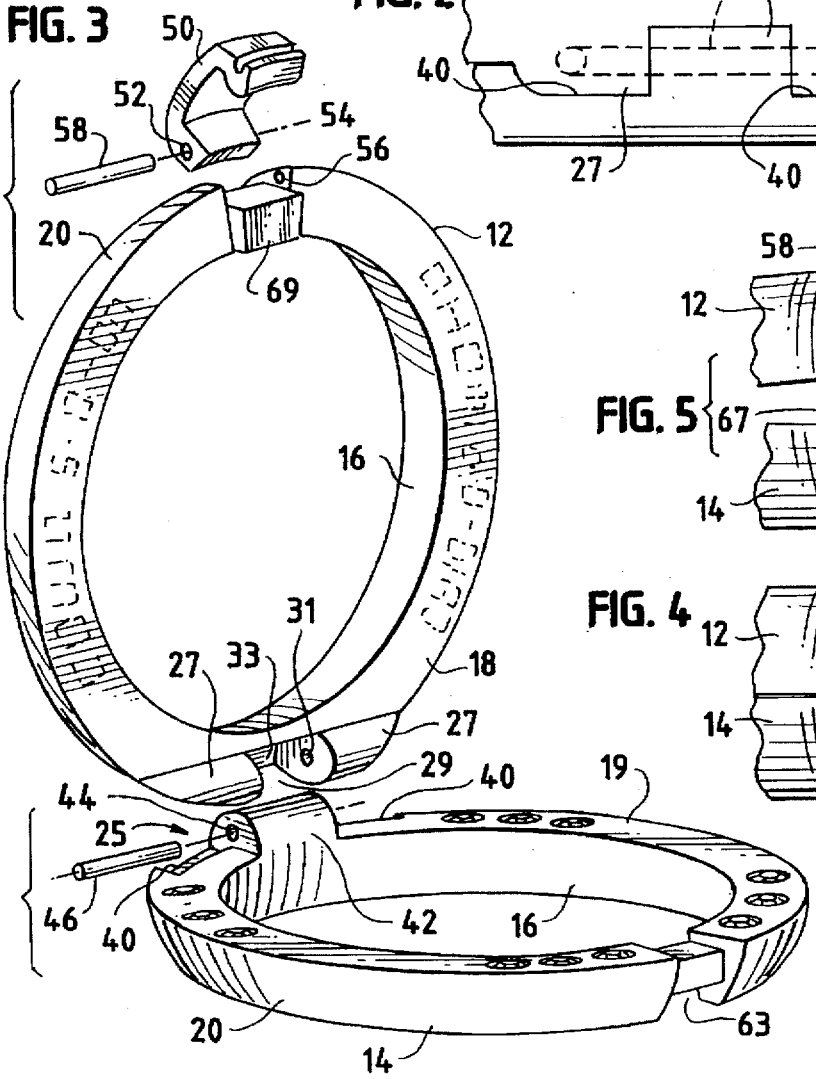
FIG. 3 is on a exploded perspective view of the finger ring in the open position.

In FIGS. 1 and 3, illustrations of a finger ring 10 made in accordance with the principles of the present invention are shown in two different positions. In particular, FIG. 1 illustrates the finger ring 10 with the ring elements in their closed position, and FIG. 3 illustrates the finger ring 10 with the ring elements in their open position. In the preferred embodiment, the finger ring has a first toroidal member 12 and a second toroidal member 14 that are arranged, when closed, in an adjacent and axial relationship to one another. The principles of the present invention encompass a finger ring having more than two members as well as members that are oval, square or any other shape suitable for a finger ring.

In the preferred embodiment, the first and second members 12, 14 are toroidal in shape having a circular inner surface 16, mating surfaces 18, 19 and outer surface 20. The mating surfaces 18, 19 of both members are generally disc shaped and planar. The planer arrangement permits the two disc shaped mating surfaces 18, 19 to be closely adjacent each other when the finger ring 10 is in its closed position without presenting any gaps or spaces around the outer surface 20 of the finger ring. Likewise, the generally planar mating surfaces 18, 19 form an inner surface 16 to the ring 10 without any gaps or spaces. Thus, the finger ring 10 has a unitary appearance in the closed position. The outer surfaces 20 of each of the toroidal members can be of any shape. For the comfort of the ring wearer, the inner and outer surfaces 16, 20 are slightly beveled, rounded and smooth.

Figure 2:
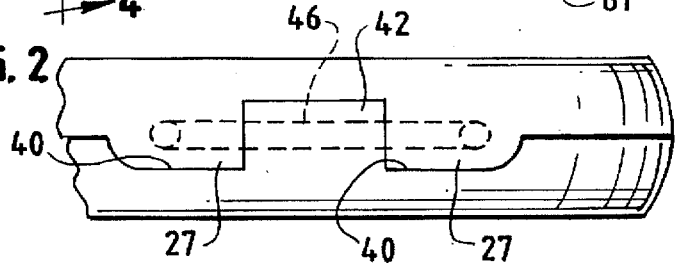
FIG. 2 is a sectional view of the hinge connecting the first and second members and with the members in the closed position.

As seen in FIG. 2, the first toroidal member 12 is movably connected to the second toroidal member 14 at a point on each member by a hinge 25. At the hinge point of the ring 10, the first toroidal member 12 includes two protrusions 27 extending from the mating surface 18 and separated from one another by a gap 29. The outer surfaces of the protrusions 27 are rounded. Through the longitudinal center of each rounded protrusion 27, a pin hole 31 is provided. In the gap 29 of the first toroidal member 12, an indent 33 is provided into the mating surface 18. The combination of the protrusions 27 and the indent 33 creates a generally U-shaped cross-section, as seen in FIG. 2.

At the hinge point of the second toroidal member 14, two reliefs 40 are provided into the mating surface 19 that are generally the same dimensions as the rounded protrusions 27. The reliefs 40 are separated by a space generally equal to the gap 29 of the first toroidal member 12. The surfaces of the reliefs 40 are also rounded. Between the reliefs 40, the second toroidal member includes a rounded elevated portion 42. Through longitudinal center of the elevated portion 42, a pin hole 44 is provided.

To form the hinge 25, the elevated portion 42 of the second member fits into the indent 33 of the first member 12, and the rounded protrusions 27 of the first member 12 fits into the reliefs 40 of the second member 14. In this arrangement, the pin holes 31 of the protrusions 27 align with the pin hole 44 of the elevated portion 42 so that a pin 46 can be inserted through the holes 31, 44. With the pin 46 in the holes 31, 44, the first and second toroidal members 12, 14 are secured together in an adjacent and axial alignment. As each surface of the hinge elements are rounded, the first and second toroidal members 12, 14 easily rotate about the pin 46 to form the hinge 25.

Figure 5:
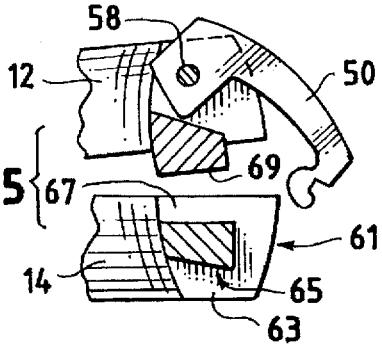
FIG. 5 is a fragmentary view of an alternate form of the clasp.
Figure 4:
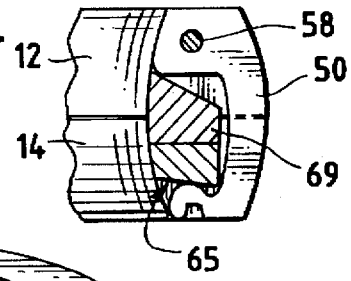
FIG. 4 is a fragmentary sectional view taken substantially in the plane of line 4—4 in FIG. 1 and showing the clasp and the catch of the present invention with the clasp and the members in the closed position.

At a point on the finger ring 10 opposite the hinge 25, a clasp 50 is provided. As seen in FIGS. 3–6 the clasp 50 has a generally C-shaped cross section. One end of the clasp has a hole 52 oriented longitudinally. In the preferred embodiment of the clasp 50, the other end has a generally reversed S-shape. The first toroidal member 12 has a gap 54 provided into the outer surface diametrically opposite the hinge 25. The size of the gap 12 is generally the size of the clasp's width so that the pin end of the clasp 50 fits into the gap 54. Into the internal surfaces of the first toroidal member created by the gap 54, holes 56 are provided. When the pin end of the clasp 50 is positioned into the gap 54, the hole 52 of the clasp 50 aligns with the holes 56 in the internal surfaces as the first toroidal member 12. A pin 58 is positioned within the holes 52, 56 so that the clasp 50 is journaled to the first toroidal member 12 forming a clasp hinge. Thus, the clasp 50 rotates about the pin 58 between a closed (FIG. 4) and an open position (FIG. 5).

A catch 61 is provided in the second toroidal member 14. An indent 63 is positioned in the outer surface of the second toroidal member 14 at a point diametrically opposite the hinge 25. As seen in the FIGS. 4 and 5, the bottom surface 65 of the catch 61 is angled from the outer surface into the inner surface of second member 14. When the first and second toroidal members 12, 14 are placed in the closed position, the clasp 50 can be rotated from the open position (FIG. 4) to the closed position (FIG. 5) so that the reversible S-shaped end abuts and tightly engages the angled surface 65 of the catch 50. The S-shaped end of the clasp is flexible due to its shape so that the clasp 50 can slide over the catch as it is closed and opened. Because of the angled surface 65, the clasp 50 is secured in the closed position.

In the preferred embodiment of the catch 61 shown in the drawings, the catch 61 includes a gap 67 in the mating surface 20 of the second toroidal member 14. The mating surface of the first toroidal member 12 has a guide block 69 extending out from a point opposite the hinge 25. The guide block 69 is generally the same size as the gap 67 on the mating surface of the second toroidal member 14 so that the guide block 69 fits into the gap 67 when the first and second members 12, 14 are in the closed position. This arrangement adds rigidity to the clasp 50 and catch 61 configuration.

Referring back to FIG. 3, the planar mating surfaces 18, 19 of the first and second toroidal members 12, 14 can have informational 70 or decorative 72 indicia on them. For the informational indicia 70, the planar surface has letters and numbers etched into the surface to form words and dates. For the decorative indicia 72, gemstones and the like can be set into the mating surface 20 by known methods. In addition, the mating surfaces 18, 19 can have enamel inlaid into the surface. For the decorative indicia 72, the gemstones or enamel must be set and inlaid into the mating surface so that when the first and second toroidal members 12, 14 are in the closed position the indicia 70, 72 does not inhibit the members 12, 14 from being adjacent to one another and the finger ring 10 having a unitary appearance.

Figure 6:
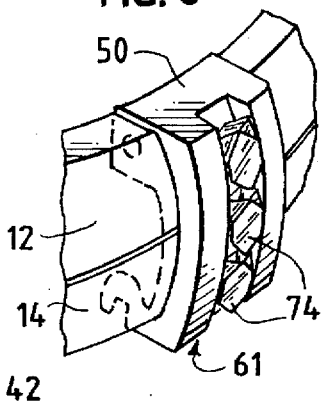
FIG. 6 is a sectional view of the clasp in the closed position with decorative indicia on the outer surface.

The finger ring 10 can also have informational and decorative indicia on the outer surfaces 20 of the first and second member 12, 14. For gemstones 74 and the like, the stones will be set into or onto the outer surface by known methods. One such embodiment is shown in FIG. 6 where gemstones 74 are set into the clasp 61. In this embodiment, the clasp 61 is sized so that in its closed position, the outer surface of the clasp 61 is raised above the outer surface 20 of the first and second members 12, 14 without obscuring the unitary appearance of the finger ring.

Of course, various changes and modifications of the preferred and alternative embodiments described will be apparent to one skilled in the art. Such changes can be made without departing form the spirit and scope of the invention and without diminishing its attendant advantages. It is, therefore, intended that such changes and modifications be covered by the appended claims.

What is claimed is:

1. A finger ring comprising:

a first toroidal member;

a second toroidal member located axially adjacent the first toroidal member and being hinged to the first toroidal member at a hinge point;

a clasp diametrically opposite the hinge point for latching together the first and second toroidal members in a ring configuration having a unitary appearance, one end of the clasp being hinged to the first toroidal member; and a catch diametrically opposite the hinge on the second toroidal member and directly opposite the other end of the clasp, the clasp and the catch, when engaged, forming with the toroidal members the ring of unitary appearance.

2. The finger ring according to claim 1 wherein the clasp has a generally c-shaped cross section with one end of the c-shaped clasp being connected to the first toroidal member with a pin forming a clasp hinge.

3. The finger ring according to claim 2 wherein the other end of the c-shaped clasp is flexible to securely fasten to the catch when the clasp and the catch are engaged.

4. The finger ring according to claim 1 wherein the catch comprises an indent on an outer surface of the second toroidal member, the first slot having the clasp removably engaged thereby forming the unitary appearance.

5. The finger ring according to claim 4 wherein the catch further comprises:

a gap formed on a substantially planer mating surface of the first toroidal member;

wherein the first toroidal member comprises a guide block located diametrically opposed the hinge point located on a substantially planer mating surface; and wherein the guide fits into the gap when the clasp and the catch are engaged.

6. The finger ring according to claim 1 wherein the first and second toroidal members each having radially extending substantially planer disc mating surfaces arranged to confront one another when the ring is closed into its unitary appearance, at least one of the mating surfaces bearing decorative or informative indicia which may be viewed when the first and second toroidal members are rotated about the hinge into the open position and hidden when the first and second toroidal members are rotated about the hinge into the closed position.

7. The ring according to claim 1 wherein the clasp has an outer surface forming a part of the unitary appearance, and wherein the outer surface of the clasp bears decorative or informative indicia.

8. A finger ring comprising:

a first toroidal member;

a second toroidal member located axially adjacent the first toroidal member and being hinged to the first toroidal member at a hinge point;

a clasp having a generally C-shaped cross-section with one end journaled to the first toroidal member so that the clasp can rotate between an open and closed position, the clasp located diametrically opposite the hinge point for latching together the first and second toroidal members in the ring configuration and the clasp having an outer surface providing a unitary appearance when the first and second toroidal members are closed and the clasp is engaged with the second toroidal member; and the first and second toroidal members each having a radially extending substantially planer disc mating surfaces arranged to confront one another when the ring is closed into its unitary appearance, at least one of the circular surfaces bearing decorative or informative indicia which may be viewed when the ring is open and which are hidden when the ring is closed.

9. The finger ring according to claim 8 wherein the informative indicia is engraved into at least one of the mating surfaces.

10. The finger ring according to claim 8 wherein the decorative indicia are gemstones are set into at least one of the mating surface.

11. The finger ring according to claim 8 further comprising a catch located diametrically opposite the hinge point on the second toroidal member and directly, the clasp and the catch, when engaged, forming with the toroidal members the ring of unitary appearance.

12. The finger ring according to claim 11 wherein the catch comprises a first slot positioned on the outer circular surface of the second toroidal member and wherein the clasp has a generally c-shaped cross-section with one end journaled upon to the first toroidal member, and wherein the other end of the clasp fits into the slot of the second toroidal member to form the ring unitary appearance.

13. The finger ring according to claim 12 wherein the other end of the clasp is flexible to engage with the catch.

14. The finger ring according to claim 11 wherein the catch further comprises a second slot in the mating surface of the second toroidal member and the first toroidal member having a guide block diametrically opposite the hinge point and located on the mating surface of the first toroidal member, the guide block being engaged with the second slot when the clasp and catch are engaged so as to form the ring having the unitary appearance.

15. The finger ring according to claim 8 wherein the outer surface of the clasp bears decorative indicia.

16. The finger ring according to claim 15 wherein the decorative indicia of the clasp are gemstones.

17. A piece of finger jewelry comprising:

a first member;

a second member located axially adjacent the member and being hinged to the first member at a hinge point;

a clasp opposite the hinge point for clasping together the first and second members in a configuration having a unitary appearance, one end of the clasp being hinged to the first member; and a catch opposite the hinge on the second member and directly opposite the other end of the clasp, the clasp and the catch, when engaged, forming with the members a piece of jewelry having a unitary appearance.

18. The piece of finger jewelry according to claim 17 wherein the first and second members are toroidal.

* * * * *